US005181500A

United States Patent [19]

Chamberland

[11] Patent Number: 5,181,500

[45] Date of Patent: Jan. 26, 1993

[54] PINCERS FOR THROWING AND CATCHING A FLYING DISC

[76] Inventor: Marc Chamberland, R.R. #6, Box 17, Cobourg, Ontario, Canada, K9A 4J9

[21] Appl. No.: 695,906

[22] Filed: May 6, 1991

[51] Int. Cl.[5] ..... A63B 65/00

[52] U.S. Cl. ..... 124/5; 124/42; 81/418; 273/318

[58] Field of Search ..... 124/5, 42, 10; 273/318, 273/327, 412, 424, 425; 294/3, 169, 8.5, 11; 81/342, 351, 381, 383, 426.5, 300, 420

[56] References Cited

U.S. PATENT DOCUMENTS

| | | | |
|---|---|---|---|
| 689,731 | 12/1901 | Lammers | 294/8.5 |
| 1,484,100 | 2/1924 | Wertz | 294/11 |
| 1,508,967 | 9/1924 | Fernandez | 294/3 |
| 2,082,699 | 6/1937 | Keppinger | 294/3 |
| 2,488,484 | 11/1949 | Vander Clute | 81/420 X |
| 2,535,215 | 12/1950 | Klenk | 81/381 X |
| 2,690,339 | 9/1954 | Hall | 124/5 X |
| 2,887,110 | 5/1959 | Roeschmann | 81/300 |
| 3,075,769 | 1/1963 | Cunningham | 273/318 |
| 3,384,411 | 5/1968 | Zlotnicki | 81/381 X |
| 4,155,552 | 5/1979 | Jacobo et al. | 124/5 X |
| 4,905,988 | 3/1990 | Mooneyhan | 273/318 X |

*Primary Examiner*—Randolph A. Reese
*Assistant Examiner*—Jeffrey L. Thompson
*Attorney, Agent, or Firm*—Wegner, Cantor, Mueller & Player

[57] ABSTRACT

Pincers are describe for throwing and catching a flying disc such as a FRISBEE (a trade mark). The pincers are made up of a pair of pivotally interconnected jaws for selectively grasping and releasing the flying disc. The jaws are operated by a pair of handles which are pivotally attached to each other and each of which is pivotally attached to a separate jaw. Opening and closing of the handles produce a like opening and closing of the jaws with resulting grasping and releasing of the disc.

5 Claims, 2 Drawing Sheets

PINCERS FOR THROWING AND CATCHING A FLYING DISC

CROSS REFERENCE TO PRIOR ACT

U.S. Pat. No. 1,186,098 to Horst—HAND TRAP issued Jun. 6, 1916;

U.S. Pat. No. 1,700,880 Camp—TARGET TRAP issued Feb. 5, 1929;

U.S. Pat. No. 1,865,173 to Dickerman—TARGET THROWER issued Jun. 28, 1932;

U.S. Pat. No. 2,122,984 to Loomis—HAND TRAP issued Jul. 5, 1938;

U.S. Pat. No. 2,124,738 to Johnsen—HAND TRAP issued Jul. 26, 1938;

U.S. Pat. No. 3,537,438 to Reed—HAND-OPERATED TARGET PROJECTING DEVICE issued Nov. 3, 1970;

U.S. Pat. No. 4,076,004 to Huelskamp—HAND LAUNCHER FOR CLAY PIGEONS issued Feb. 28, 1978;

U.S. Pat. No. 4,233,952 to Perkins—HAND CATAPULT DEVICE issued Nov. 18, 1980;

BACKGROUND OF THE INVENTION

This invention relates to a device for catching and throwing a projectile. More particularly the invention relates to pincers for launching a flying disc such as a FRISBEE (a trade mark) in flight and for intercepting and grabbing the disc as it is travelling through the air.

Devices are known for launching projectiles such as FRISBEES in flight. The U.S. patent to Perkins, referred to above, illustrates one such device. That device includes a yoke for engaging the device and an elastic band which serves as a catapult. When the device is attached to the yoke and is swung upward the device is projected into the air.

Devices such as that described in the Perkins patent suffer from a number of shortcomings. They can for example only be used for launching discs into the air; they cannot be used for catching them when they are in flight. Moreover such devices employ mechanical means, such as a catapult, for accelerating the discs through the air. In addition to the foregoing such devices are relatively complicated of construction and hence are relatively expensive to produce.

SUMMARY OF THE INVENTION

It is an object of this invention to provide a device which is suitable not only for launching a flying disc such as a FRISBEE into the air but also for catching it in flight.

Another object of the invention is to provide a device which employs no mechanical means for accelerating the disc in flight. The physical exertion and skill of the operator of the device alone will determine its speed and trajectory. In that respect the operator will have no undue advantage over a person who throws the disc by hand.

A still further object is to provide a device for improving an operator's grip on a flying disc. By means of the device the operator may with facility and accuracy launch a flying disc into the air and catch it in flight.

These and other objects are accomplished by pincers for throwing and catching a flying disc comprising: a pair of pivotally interconnected jaws for selectively engaging and disengaging the disc; and a pair of pivotally interconnected handles each pivotally connected to a separate jaw such that opening and closing of the handles produces a like opening and closing of the jaws with resulting disengagement and engagement of the disc.

DESCRIPTION OF THE DRAWINGS

Like reference characters refer to like parts throughout the description of the drawings.

DESCRIPTION OF PREFERRED EMBODIMENT

Figure 1:
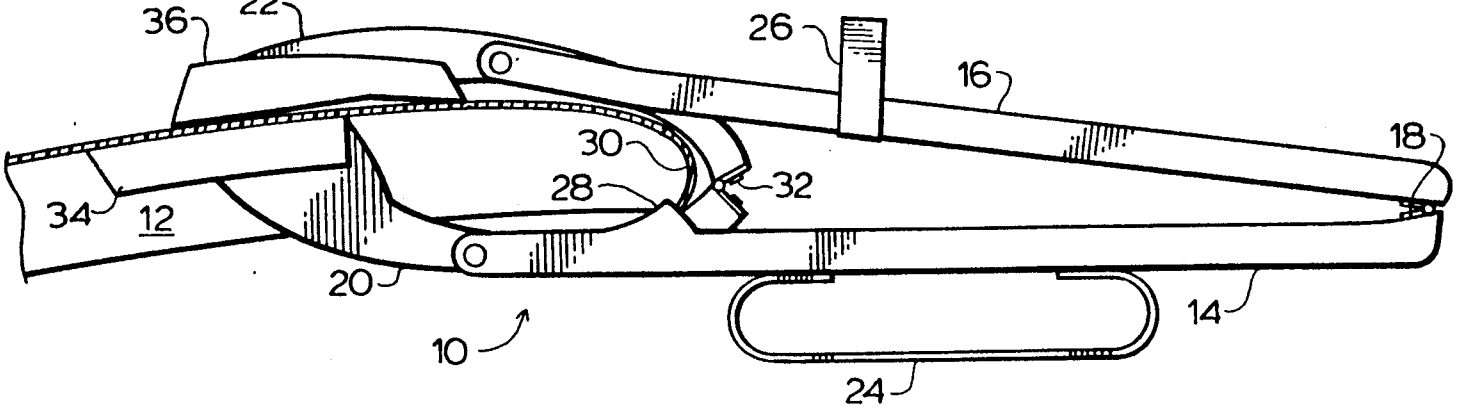
FIG. 1 is an elevation of the pincers in a closed position and in conjunction with a portion of a flying disc.

With reference to FIG. 1, the pincers for throwing and catching a flying disc is indicated generally by the numeral 10 and is shown in conjunction with a flying disc, generally 12.

The pincers include a pair of handles 14, 16 which are pivotally interconnected at one end by means of a hinge 18. Their other ends are pivotally interconnected to a pair of jaws 20, 22. The point of interconnection of the handles with the jaws is approximately mid-way between the ends of the jaws.

Figure 4:
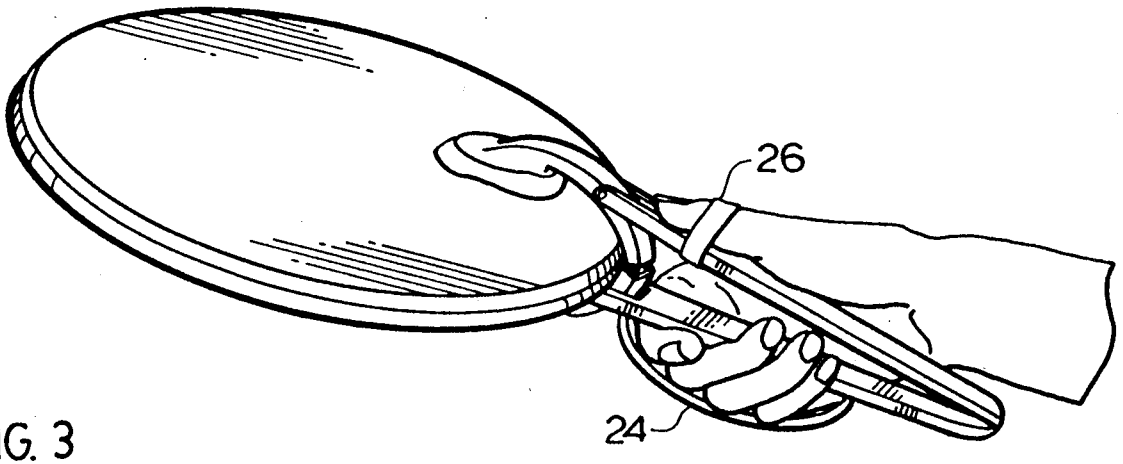
FIG. 4 is another elevation of the pincers in conjunction with a flying disc showing the manner in which the pincers are held.
Figure 3:
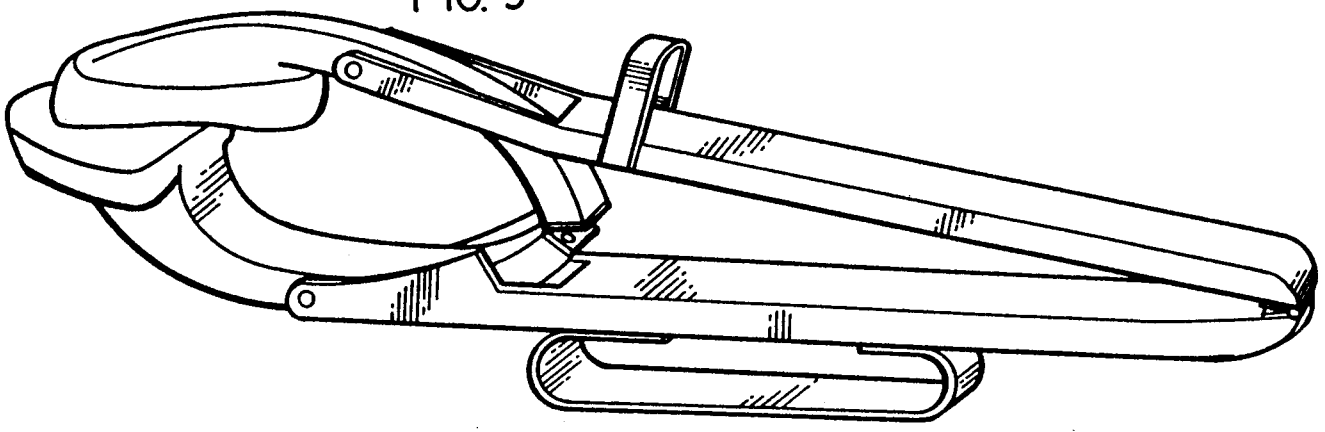
FIG. 3 is a perspective view of the pincers shown closed.

A strap 24, 26 is attached to each handle 14, 16 respectively. Each strap is in the shape of a loop, the larger of which, 24, accommodates the thrower's fingers as illustrated in FIG. 4 and the smaller of which, 26, accommodates his thumb. The pincers can be held by either the thrower's left or right hands.

A ledge 28 is formed on the wall of handle 14 facing the other handle. The ledge is placed such that it will engage the outer edge 30 of the flying disc when it is held by the jaws.

The jaws are arcuate in shape and are interconnected at one end by means of a hinge 32. Preferably the handles and jaws are composed of molded polymeric material.

Pads 34, 36 are connected to the free ends of the jaws. The outer faces of the pads conform generally to the shape of the areas of the disc contacted by them. Those faces are composed of soft, relatively pliable material to ensure that contact occurs across their entire surfaces with the disc.

Figure 2:
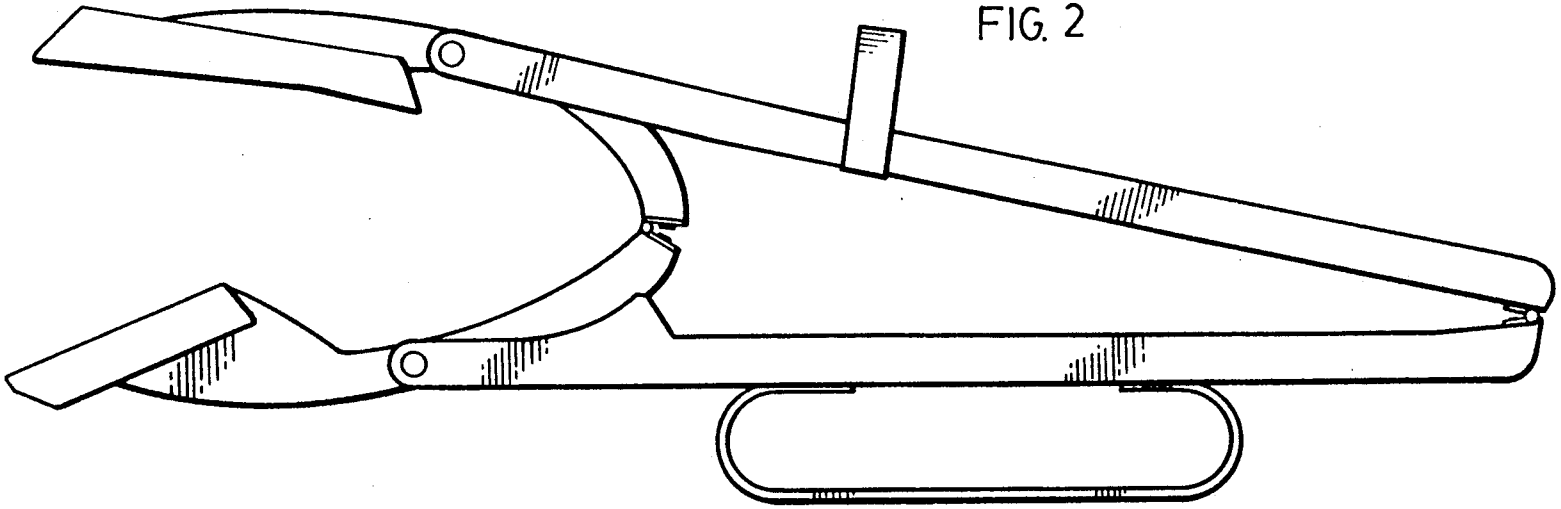
FIG. 2 is another elevation of the pincers in an open position.

FIG. 2 illustrates the pincers open after the disc has been thrown or launched. In that figure, the ends of the handles connected to the jaws are separated from one another as are the pads attached to the jaws.

In operation, the flying disc is engaged by the pincers by closing the handles manually in order to bring the pads into contact with the upper and lower walls of the disc. The lower edge of the disc should be adjacent to the lower ends of the jaws so that ledge 28 is beneath and engages the lower edge of the disc. The disc will then be prevented from moving relative to the pincers so that when the device is swung through the air, the disc will swing with it and will not slide or otherwise alter its position relative to it. The path that the disc takes prior to release from the pincers can accordingly be precisely controlled with resulting control over its trajectory after being released.

The pincers are also useful for catching a disc that is travelling through the air. To this end, the handles are opened manually with resulting opening of the jaws to the position illustrated in FIG. 2. The pincers can then be used as a pincer for catching or grabbing the disc from the air on its approach. The forward movement of the disc is arrested as it contacts the jaws of the device. The curved inner surface of jaw 22 serves to direct the forward edge of the disc into engagement with ledge 28 when the handles are closed so that the disc will be ready for immediate relaunching. The ledge serves not only to anchor the disc solidly to the pincers but serves to prevent the disc from bouncing out from the device if the thrower does not act quickly enough to close the handles when the jaws contact the pincers.

It will be understood of course that modifications can be made in the preferred embodiments illustrated and described herein without departing from the scope and purview of the invention as defined in the appended claims.

The embodiments of the invention in which an exclusive property or privilege is claimed are defined as follows:

1. Pincers for throwing and catching a flying disc comprising: first and second jaws, each jaw having first ends pivotally interconnected, a second end of each said first and second jaws having a pad connected thereto, each said pad facing the pad connected to the other of said jaws, said pads having portions configured to selectively engage and disengage said disc, a pair of handles, each handle having one end connected to one of said jaws at a point intermediate the ends of said jaws whereby opening and closing of said handles provide for a corresponding opening and closing of said jaws with resulting disengagement and engagement of said disc by said pads and wherein the other ends of said handles are connected together.

2. The pincers as claimed in claim 1 wherein one of said handles has an incline ledge to engage an edge of said disc and to minimize movement of said disc relative to said pincers, while said disc is engaged by said jaws.

3. The pincers as claimed in claim 2 wherein said pads are composed of relatively pliable material conforming to the shape of the area of said disc contacted thereby.

4. The pincers as claimed in claim 1 wherein said pads are composed of relatively pliable material conforming to the shape of the area of said disc contacted thereby.

5. The pincers as claimed in claim 1, wherein the ends of the handles not connected to said jaws are pivotally interconnected.

* * * * *